US008820103B2

(12) United States Patent
Jeong et al.

(10) Patent No.: US 8,820,103 B2
(45) Date of Patent: Sep. 2, 2014

(54) AIR CONDITIONER HAVING PLURAL COMPRESSORS WITH OIL BYPASS UNIT

(75) Inventors: Hojong Jeong, Seoul (KR); Sedong Chang, Seoul (KR); Baikyoung Chung, Seoul (KR); Jiyoung Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 850 days.

(21) Appl. No.: 12/976,348

(22) Filed: Dec. 22, 2010

(65) Prior Publication Data

US 2011/0155816 A1 Jun. 30, 2011

(30) Foreign Application Priority Data

Dec. 24, 2009 (KR) ..... 10-2009-0130421

(51) Int. Cl.
*F25B 31/00* (2006.01)
*F25B 43/02* (2006.01)
*F25B 1/10* (2006.01)

(52) U.S. Cl.
CPC ..... *F25B 31/004* (2013.01); *F25B 2400/075* (2013.01); *F25B 2600/2513* (2013.01); *F25B 2700/2105* (2013.01)
USPC ..... 62/193; 62/84; 62/192; 62/468; 62/470; 62/510

(58) Field of Classification Search
USPC ..... 62/192, 193, 468, 470, 510, 84
See application file for complete search history.

(56) References Cited

U.S. PATENT DOCUMENTS 4,926,652 A 5/1990 Kitamoto
5,586,450 A * 12/1996 Tollar et al. ..... 62/192
7,231,783 B2 * 6/2007 Esslinger et al. ..... 62/468
2002/0073721 A1 * 6/2002 Seo et al. ..... 62/228.3
2003/0213254 A1 11/2003 Koo
2005/0092000 A1 * 5/2005 Hwang et al. ..... 62/193
2005/0138957 A1 * 6/2005 Lee et al. ..... 62/510
2009/0107173 A1 4/2009 Yoon et al.

FOREIGN PATENT DOCUMENTS

CN 1491321 A 4/2004
CN 1614340 A 5/2005
CN 1751213 A 3/2006
EP 1367259 A1 12/2003
EP 1826512 A2 9/2004
EP 1 605 211 A1 12/2005
EP 1605211 A1 12/2005
EP 1677057 A2 7/2006
GB 2241317 A 8/1991
JP 2004-263996 9/2004
KR 1993-004382 5/1993
WO WO 2008/140454 A1 11/2008
WO WO 2009/039873 A1 * 4/2009 ..... F25B 31/00
WO WO 2009/054593 A1 4/2009

* cited by examiner

*Primary Examiner* — Mohammad M Ali
*Assistant Examiner* — Daniel C Comings
(74) *Attorney, Agent, or Firm* — McKenna Long & Aldridge LLP

(57) ABSTRACT

An air conditioner includes a plurality of compressors, an intake passageway, a bypass unit, and an expansion valve. The intake passageway distributes a fluid to each of the compressors. The bypass unit includes a plurality of bypass pipes connected respectively to the compressors and a common bypass pipe to discharge the fluids from the compressors to the intake passageway. The expansion valve is provided to the bypass unit to control a flow of fluid from the common bypass pipe to the intake unit.

10 Claims, 5 Drawing Sheets

AIR CONDITIONER HAVING PLURAL COMPRESSORS WITH OIL BYPASS UNIT

CROSS-REFERENCE TO RELATED APPLICATIONS

The present application claims priority under 35 U.S.C. 119 and 35 U.S.C. 365 to Korean Patent Application No. 10-2009-0130421 (filed on Dec. 24, 2009), which is hereby incorporated by reference in its entirety.

BACKGROUND

Embodiments relate to an air conditioner and a method of controlling the air conditioner.

Air conditioners perform a cycle of compression, condensation, expansion, and evaporation to control the temperature or humidity of air.

Typically, a plurality of indoor units of an air conditioner are connected to at least one outdoor unit. The outdoor may include a plurality of compressors according to the capacity of the indoor units.

Further an oil separator for separating oil may be disposed at a discharge side of each compressor. Oil separated at each oil separator is moved to an intake side of each compressor through an oil recycle pipe.

Because oil separated at each oil separator connected to each compressor is returned to the intake side of the compressor, oil levels between the compressors may be unbalanced. Furthermore, when oil is insufficiently stored in the compressor, inner parts thereof may be worn.

SUMMARY

Embodiments provide an air conditioner and a method of controlling the air conditioner.

In one embodiment, an air conditioner includes a plurality of compressors; and intake passageway configured to distribute a fluid to each of the plurality of compressors; a bypass unit including a plurality of bypass pipes connected respectively to the compressors to discharge the fluids from the compressors to a common bypass pipe. The common bypass is disposed between the plurality of bypass pipes and the intake passageway; and an expansion valve disposed between the common bypass pipe and the intake passageway to control a flow rate of fluid from the common bypass pipe to the intake passageway.

In another embodiment, an air conditioner includes: a plurality of compressors; a fluid intake pipe unit configured to distribute a fluid to each of the compressors; a bypass unit including a plurality of bypass pipes connected respectively to the compressors and a common bypass passageway; and a plurality of temperature sensors configured to sense temperatures of the fluids flowing through the bypass pipes; and a valve. An operation of the valve is controlled according to temperature information sensed at each of the temperature sensors.

In another embodiment, an air conditioner comprises a plurality of compressors; a fluid intake unit configured to distribute a fluid to each of the compressors and a fluid bypass unit. The fluid bypass unit includes a plurality of bypass pipes attached respectively to the compressors to discharge the fluids from the compressors; a common bypass pipe, wherein the common bypass pipe is disposed to connect the plurality of bypass pipes and the fluid intake unit; a plurality of depressurization parts, wherein each of the depressurization parts are provided respectively with each of the bypass pipes; and a plurality of temperature sensors, wherein each of the temperatures sensors are disposed to sense temperatures of fluids discharged from the depressurizing parts; and an expansion valve disposed between the common bypass pipe and the fluid intake unit to adjust a flow rate of fluid flowing from the common bypass pipe to the fluid intake unit.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
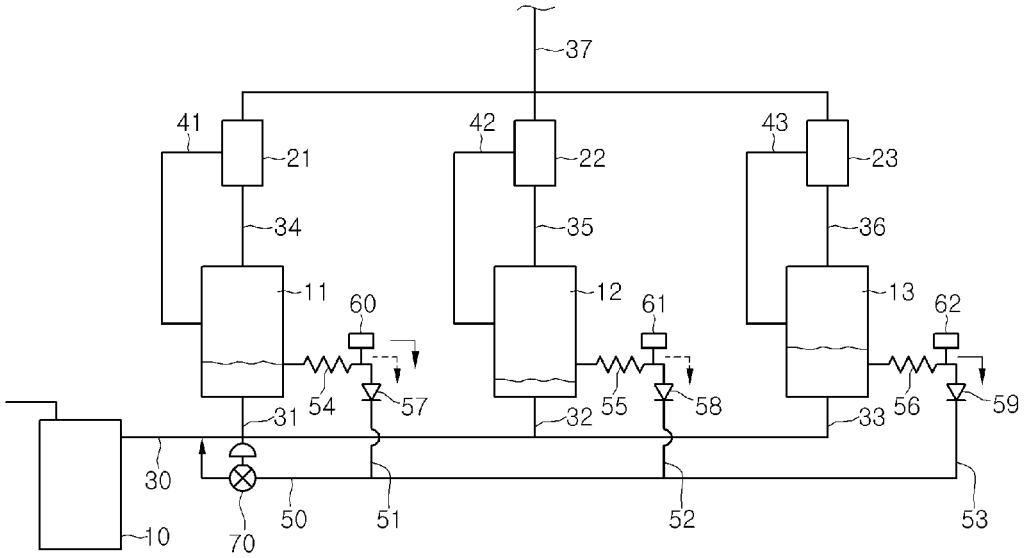
FIG. 1 is a schematic view illustrating a portion of a refrigerant cycle of an air conditioner according to a first embodiment.

FIG. 1 is a schematic view illustrating a portion of a refrigerant cycle of an air conditioner according to a first embodiment.

Referring to FIG. 1, the air conditioner includes a plurality of compressors 11, 12, and 13, which are arranged in parallel. The number of the compressors 11, 12, and 13 is three, but the present disclosure is not limited thereto and can be any suitable number known to one of ordinary skill in the art.

In the some embodiments, the compressors 11, 12, and may have different capacities from each other. In other embodiments, the compressors may have the same capacity. Further, the compressors may be different types. For example, one of the compressors 11, 12, and 13 may be an inverter compressor that is variable in the number of rotations, and another one may be a constant speed compressor. In other embodiments, the compressors may all be the same type.

An intake pipe unit for introducing refrigerant discharged from an evaporator (not shown) is connected to each of the compressors 11, 12, and 13. The intake pipe unit includes a common intake pipe 30 where the refrigerant discharged from the evaporator flows, and a plurality of individual intake pipes 31, 32, and 33 that are branched from the common intake pipe 30 and connected to the compressors 11, 12, and 13.

Thus, the refrigerant introduced to the common intake pipe 30 is distributed to the individual intake pipes 31, 32, and 33, and then, is moved to the compressors 11, 12, and 13. The common intake pipe 30 is connected to an accumulator 10. The accumulator 10 divides the refrigerant discharged from the evaporator into vapor refrigerant and liquid refrigerant.

Then, only the vapor refrigerant is moved to the common intake pipe 30, and the liquid refrigerant is stored in the accumulator 10.

Each of the compressors 11, 12, and 13 is connected with a discharge pipe unit where the refrigerant discharged from each of the compressors 11, 12, and 13 flows. The discharge pipe unit includes a plurality of individual discharge pipes 34, 35, and 36 that are connected respectively to the compressors 11, 12, and 13, and a common discharge pipe 37 where the refrigerator flowing through the individual discharge pipes 34, 35, and 36 are collected.

Thus, the refrigerant discharged from the compressors 11, 12, and 13 flows along the individual discharge pipes 34, 35, and 36, and is collected in the common discharge pipe 37, and then, is moved to a condenser (not shown).

The individual discharge pipes 34, 35, and 36 are provided with oil separators 21, 22, and 23 that separate the refrigerant and oil discharged from the compressors 11, 12, and 13.

The oil separators 21, 22, and 23 are connected with oil recycle pipes 41, 42, and 43 for recycling the oil separated in the oil separators 21, 22, and 23 to the compressors 11, 12, and 13.

Thus, the refrigerant and oil discharged from the compressors 11, 12, and 13 are separated from each other in the oil separators 21, 22, and 23, and the separated oil is circulated back to the compressors 11, 12, and 13 corresponding respectively to the oil separators 21, 22, and 23.

When an excessive amount of oil is stored within the compressors 11, 12, and 13, a bypass unit for discharging the excessive amount of oil out of the compressors 11, 12, and 13 is connected to each of the compressors 11, 12, and 13.

The bypass unit includes a plurality of bypass pipes 51, 52, and 53 that are connected respectively to the compressors 11, 12, and 13, and a common pipe 50 for collecting oil flowing along the bypass pipes 51, 52, and 53. The common pipe 50 is connected to the common intake pipe 30.

The bypass pipes 51, 52, and 53 are connected to the compressors 11, 12, and 13 at a minimum limit oil level or greater.

Since the minimum limit oil level required in the compressors 11, 12, and 13 is varied according to the capacity of the compressors 11, 12, and 13, connection positions of the bypass pipes 51, 52, and 53 may be different from each other.

The bypass pipes 51, 52, and 53 are provided with depressurizing parts 54, 55, and 56 that depressurize fluids discharged from the compressors 11, 12, and 13; and check valves 57, 58, and 59, respectively. The check valves 57, 58, and 59 are installed at the downstream sides of the depressurizing parts 54, 55, and 56. For example, capillaries may be used as the depressurizing parts 54, 55, and 56.

In detail, high pressure compressors may be used as the compressors 11, 12, and 13. The high pressure compressors have high pressure oil storage spaces. As such, when the high pressure compressors are used, fluids are discharged from the compressors 11, 12, and 13 to the bypass pipes 51, 52, and 53 due to the inner pressure of the compressors 11, 12, and 13.

The check valves 57, 58, and 59 are one-directional values prevent a fluid from being introduced from an operating compressor to a stopped compressor through the bypass pipe connected to the stopped compressor. For example, when the first compressor 11 operates and the second and third compressors 12 and 13 are stopped, the check valves 57, 58, and 59 prevent a fluid discharged from the first compressor 11 to the second and third compressors 12 and 13.

The depressurizing parts 54, 55, and 56 expand fluids flowing along the bypass pipes 51, 52, and 53 to decrease the temperature and pressure thereof.

In this case, the fluids may include refrigerant or oil. That is, when the amount of oil stored in the compressors 11, 12, and 13 is excessive, the oil is discharged to the bypass pipes 51, 52, and 53; and when the amount of oil is small, refrigerant is discharged to the bypass pipes 51, 52, and 53. When the oil level (i.e. surface of the oil) reaches the level of the connection location of the bypass pipes 51, 52, and 53, the refrigerant and oil are discharged to the bypass pipes 51, 52, and 53.

The refrigerant discharged from the compressors 11, 12, and 13 to the bypass pipes 51, 52, and 53 is moved to the intake sides of the compressors 11, 12, and 13. At this point, the pressure of the refrigerant introduced to the intake sides of the compressors 11, 12, and 13 should be low. However, because the pressure of the refrigerant introduced to the bypass pipes 51, 52, and 53 is high, the refrigerant flowing through the bypass pipes 51, 52, and 53 is depressurized by the depressurizing parts 54, 55, and 56 according to some embodiments.

Further in some embodiments, the bypass pipes 51, 52, and 53 are provided respectively with temperature sensors 60, 61, and 62 that measure the temperatures of fluids discharged from the depressurizing parts 54, 55, and 56. The temperature sensors 60, 61, and 62 include first, second, and third temperature sensors (also denoted respectively by 60, 61, and 62), respectively.

The common bypass pipe 50 is provided with an expansion valve 70 adjusting a flow rate. When the expansion valve 70 is opened, fluids can be discharged from the compressors 11, 12, and 13. That is, when the expansion valve 70 is opened, a fluid can flow through the bypass unit.

The use of the expansion valve 70 has several advantages as follows. When the air conditioner operates in a low temperature state, the viscosities of fluids flowing through the bypass pipes 51, 52, and 53 increase. In some embodiments, the expansion valve 70 has an excellent operation property (operation reliability) even when the viscosities are high. As such, the expansion valve 70 is installed on the common pipe 50.

The refrigerant and/or the oil discharged to the bypass pipes 51, 52, and 53 is expanded, passing through the depressurizing parts 54, 55, and 56, and thus, the temperature thereof decreases, and the temperature sensors 60, 61, and 62 sense the temperature of the refrigerant and/or the oil discharged from the depressurizing parts 54, 55, and 56.

In this case, because the temperature sensors 60, 61, and 62 are disposed at the outside of the bypass pipes 51, 52, and 53, the temperature sensors 60, 61, and 62 indirectly measure the temperature of the refrigerant and/or oil by measuring the temperatures of the bypass pipes 51, 52, and 53.

At this point, because the refrigerant and the oil have different physical properties, the refrigerant is different from the oil in a temperature variation between a state before passing through the depressurizing parts 54, 55, and 56 and a state after passing through the depressurizing parts 54, 55, and 56. A temperature drop amount of the refrigerant is greater than that of the oil. That is, a temperature drop range of the refrigerant is greater than that of the oil.

As such, because the refrigerant is different from the oil in a temperature variation range, the type of fluid discharged to the bypass pipes 51, 52, and 53 is determined using a temperature sensed at the temperature sensors 60, 61, and 62, according to the current embodiment.

The temperature variation range is greater when the temperature of a fluid discharged from the compressors 11, 12, and 13 is high in comparison to when the temperature thereof is low. Thus, in the some embodiments, a high pressure compressor may be used as a compressor.

Figure 2:
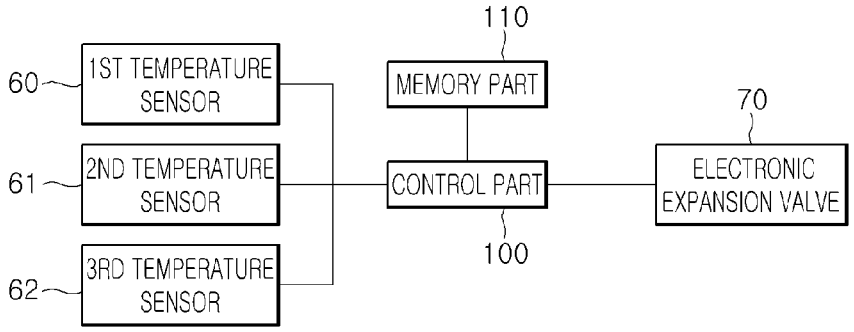
FIG. 2 is a block diagram illustrating a control configuration of the air conditioner according to the first embodiment.

FIG. 2 is a block diagram illustrating a control configuration of the air conditioner according to the first embodiment.

Referring to FIG. 2, the air conditioner includes the first to third temperature sensors 60, 61, and 62 provided to the bypass pipes 51, 52, and 53; a memory part 110 storing reference temperatures respectively of the refrigerant and oil discharged from the depressurizing parts 54, 55, and 56; a control part 100 comparing a temperature sensed at the temperature sensors 60, 61, and 62 with a temperature stored at the memory part 110; and the expansion valve 70 that is controlled by the control part 100.

In detail, the control part 100 controls the expansion valve 70 to be opened according to a set condition (open condition). In the some embodiments, the set condition may be a set time. For example, the expansion valve 70 may be opened for a predetermined time with an interval of two hours. That is, when a set time is elapsed after the expansion valve 70 is opened, the expansion valve 70 may be opened again.

Alternatively, when a predetermined time is elapsed after the air conditioner operates, the expansion valve 70 may be opened. Alternatively, when the set condition is satisfied, the number of operating compressors may be two or greater. In the some embodiments, the set condition is not limited thereto.

Thus, when the set condition is satisfied, a fluid is allowed to move from the compressors 11, 12, and 13 to the bypass pipes 51, 52, and 53. As a matter of course, only when the compressors 11, 12, and 13 operate, a fluid is allowed to move from the compressors 11, 12, and 13 to the bypass pipes 51, 52, and 53.

The memory part 110 stores a reference refrigerant temperature range R1 of the refrigerant discharged from the depressurizing parts 54, 55, and 56. The memory part 110 also stores a reference oil balance temperature range R2 of a mixed fluid of the refrigerant and oil discharged from the depressurizing parts 54, 55, and 56.

In this case, a reference oil balance temperature is higher than a reference refrigerant temperature. In detail, the temperature of the refrigerant sensed at the temperature sensors 60, 61, and 62 is lower than the temperature of the oil. When a desired amount of oil is stored in the compressors 11, 12, and 13, the oil and refrigerant are discharged to the bypass pipes 51, 52, and 53 at the same time.

The temperature sensed at the temperature sensors 60, 61, and 62 when the oil and refrigerant are discharged to the bypass pipes 51, 52, and 53 is lower than the temperature when only the oil is discharged, and is higher than the temperature when only the refrigerant is discharged.

Thus, in some embodiments, the temperature when the oil and refrigerant are discharged at the same time to the bypass pipes 51, 52, and 53 is determined as the reference oil balance temperature range R2.

The reference refrigerant temperature range R1 and the reference oil balance temperature range R2 may depend on an outdoor temperature. As the outdoor temperature increases, the temperature of the refrigerant or oil sensed at the temperature sensors 60, 61, and 62 increases. Thus, in some embodiments, the reference refrigerant temperature range R1 and the reference oil balance temperature range R2 increase as the outdoor temperature increases.

The memory part 110 stores the reference refrigerant temperature range R1 and the reference oil balance temperature range R2 corresponding to the outdoor temperature.

The control part 100 compares a temperature sensed at the temperature sensors 60, 61, and 62 with the reference refrigerant temperature range R1 and the reference oil balance temperature range R2 stored in the memory part 110 to determine whether the refrigerator and/or oil is discharged to the bypass pipes 51, 52, and 53.

The control part 100 controls opening and closing of the expansion valve 70 according to whether the refrigerant and/or the oil is discharged.

Figure 3:
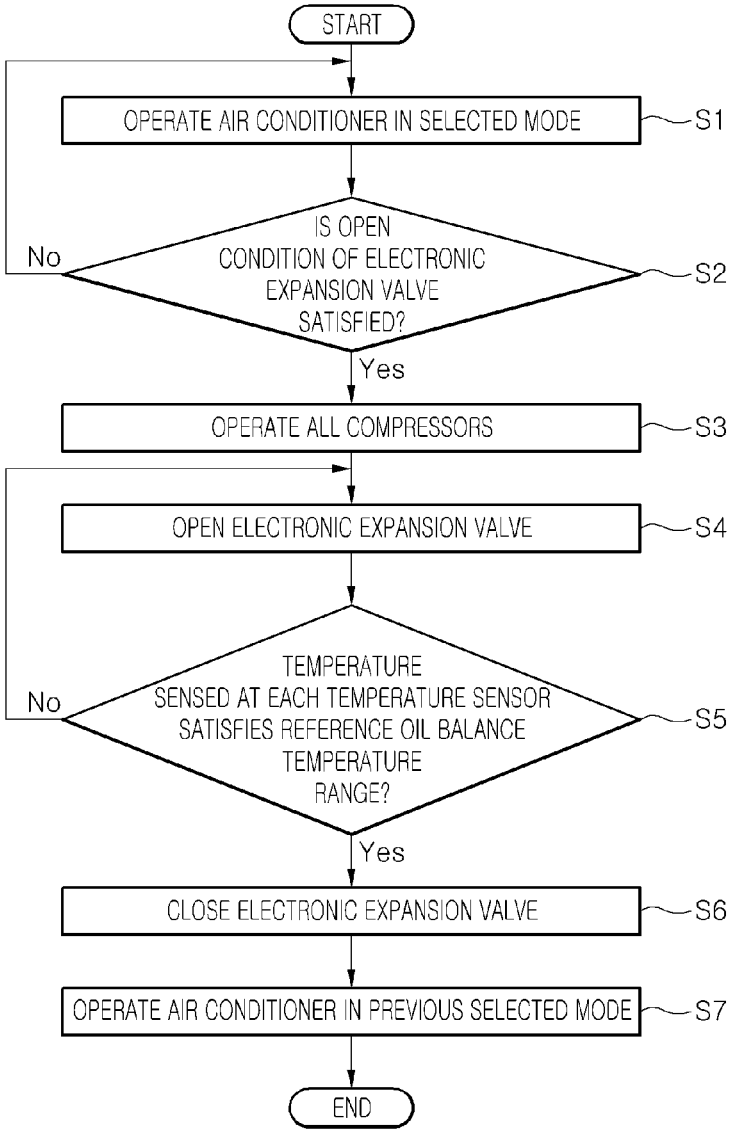
FIG. 3 is a flowchart illustrating a method of controlling the air conditioner according to the first embodiment.

FIG. 3 is a flowchart illustrating a method of controlling the air conditioner according to the first embodiment.

The method of controlling the air conditioner according to the first embodiment will be described with reference to FIGS. 1 to 3.

For example, as illustrated in FIG. 1, a desired amount of oil is stored in the first compressor 11, and a smaller amount of oil than a desired amount of oil is stored in the second compressor 12, and a larger amount of oil than a desired amount of oil is stored in the third compressor 13.

When an operation command for the air conditioner is input, the air conditioner operates in a selected mode in operation S1. At this point, at least one of the compressors 11, 12, and 13 operates.

The control part 100 determines whether an open condition of the expansion valve 70 is satisfied in operation S2. As described above, the open condition may be a case where a set time is elapsed or a case where at least two of the compressors 11, 12, and 13 operate.

When the open condition of the expansion valve 70 is satisfied, all the compressors 11, 12, and 13 are driven in operation S3. Then, the expansion valve 70 is opened in operation S4.

Then, the refrigerant introduced to the compressors 11, 12, and 13 is compressed, and the compressed refrigerant and the oil are discharged from the compressors 11, 12, and 13 to the individual discharge pipes 34, 35, and 36. At this point, the refrigerant and/or the oil is/are moved from the compressors 11, 12, and 13 to the bypass pipes 51, 52, and 53.

Referring to FIG. 1, because an oil level of the first compressor 11 is disposed to correspond to a portion of the first compressor 11 connected with the first bypass pipe 51, a portion of the compressed refrigerant and a portion of the oil are discharged from the first compressor 11 to the first bypass pipe 51.

Because an oil level of the second compressor 12 is lower than a portion of the second compressor 12 connected with the second bypass pipe 52, a portion of the compressed refrigerant (depicted with dotted line) is discharged from the second compressor 12 to the second bypass pipe 52.

Because an oil level of the third compressor 13 is higher than a portion of the third compressor 13 connected with the third bypass pipe 53, the oil (depicted with solid line) is discharged from the third compressor 13 to the third bypass pipe 53.

The refrigerant and/or the oil moving along the bypass pipes 51, 52, and 53 are expanded through the depressurizing parts 54, 55, and 56, and thus, the temperatures thereof decrease. The temperature sensors 60, 61, and 62 sense the temperatures of the refrigerant and/or the oil discharged from the depressurizing parts 54, 55, and 56.

Then, in operation S5, the control part 100 determines whether the temperatures sensed at the temperature sensors 60, 61, and 62 satisfy the reference oil balance temperature range R2 stored in the memory part 110.

In detail, when the expansion valve 70 is initially opened, the refrigerant and the oil are discharged from only the first compressor 11, and thus, a temperature sensed at the first temperature sensor 60 satisfies the reference oil balance temperature range R2, and temperatures sensed at the first and second temperature sensors 61 and 62 do not satisfy the reference oil balance temperature range R2.

The refrigerant and the oil discharged from the first compressor 11, the refrigerant discharged from the second compressor 12, and the oil discharged from the third compressor 13 are collected in the common pipe 50, and then, are moved to the common intake pipe 30.

Then, the refrigerant and the oil moved to the common intake pipe 30 are distributed to the individual intake pipes 31, 32, and 33. Accordingly, the oil is uniformly distributed to the compressors 11, 12, and 13. As a result, the oil levels of the compressors 11, 12, and 13 close to the portions connected with the bypass pipes 51, 52, and 53.

Then, the temperatures sensed at the temperature sensors 60, 61, and 62 satisfy the reference oil balance temperature range R2.

If the control part 100 determines that the temperatures sensed at the temperature sensors 60, 61, and 62 satisfy the reference oil balance temperature range R2, the expansion valve 70 is closed in operation S6. Then, the air conditioner operates in a previous mode in operation S7. For example, the compressors 11, 12, and 13 are returned to a state provided before the expansion valve 70 is opened.

According to some embodiment, when oil is excessively stored in a specific compressor, the oil is discharged from the specific compressor to the outside through the bypass pipe connected to the specific compressor, and thus, preventing the case where oil is insufficient in another compressor. Since the case where oil is insufficient in another compressor is prevented, damage of the compressor is prevented.

Furthermore, an excessive amount of oil in the specific compressor is uniformly distributed to the other compressors, thereby removing an oil level unbalance between the compressors.

In addition, since the expansion valve 70 is installed on the common bypass pipe 50, even when the air conditioner operates at low temperature, the expansion valve efficiently operates.

Figure 4:
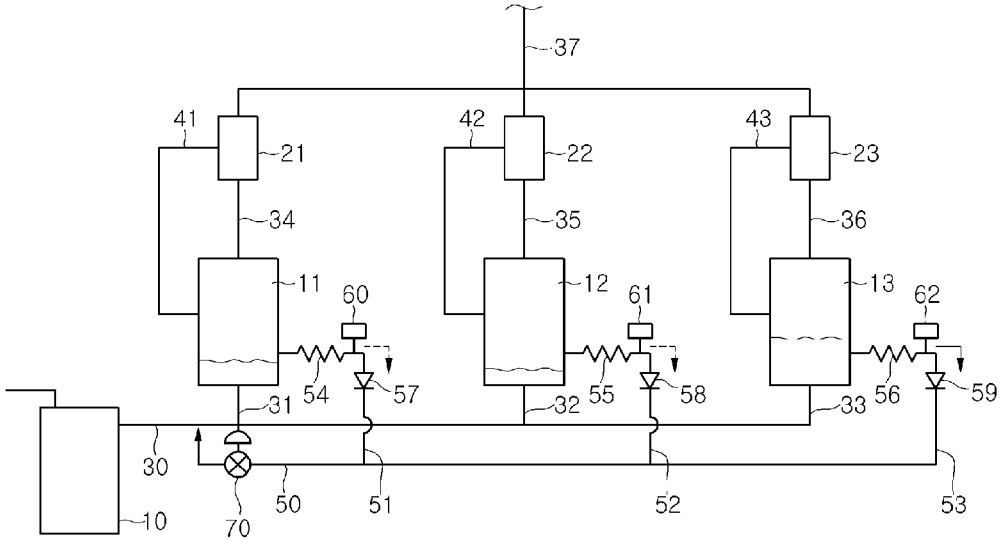
FIG. 4 is a schematic view illustrating a refrigerant cycle of an air conditioner according to a second embodiment.
Figure 5:
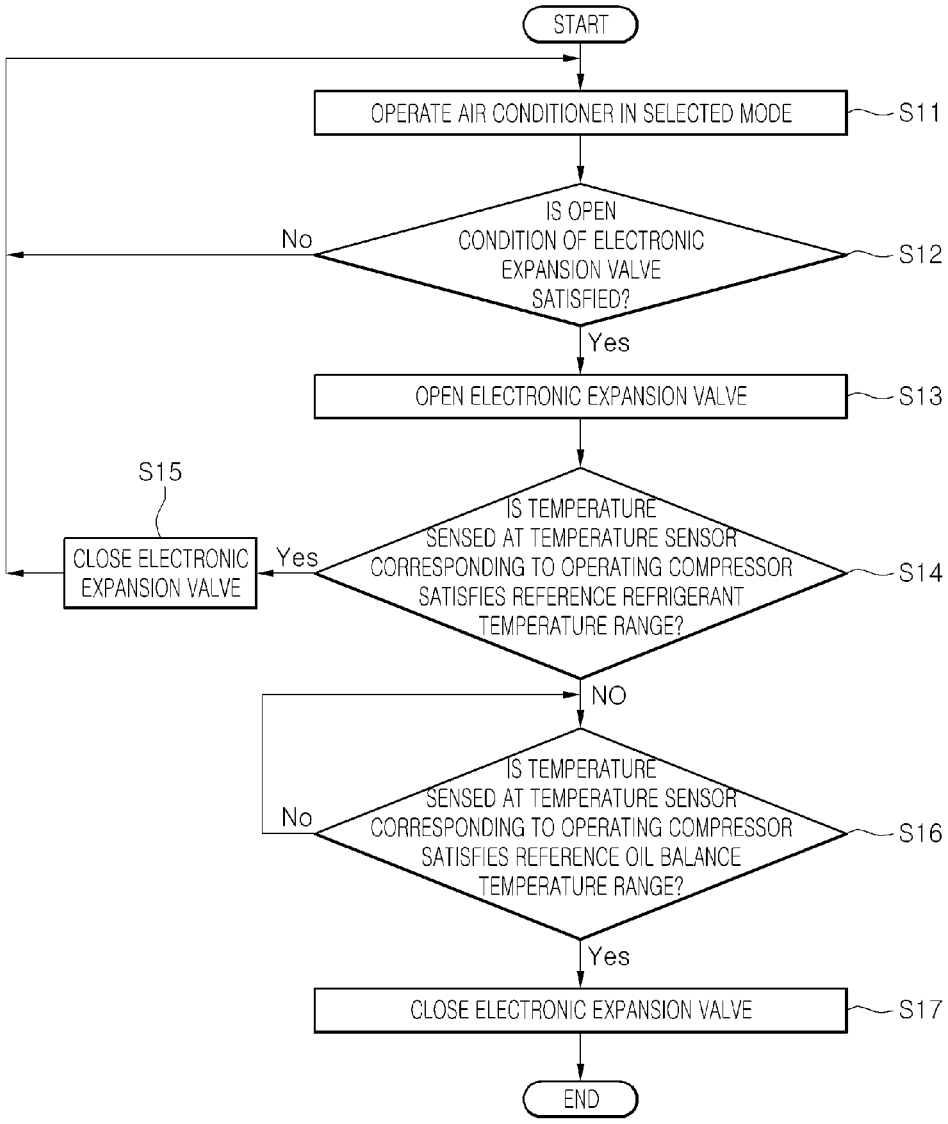
FIG. 5 is a flowchart illustrating a method of controlling the air conditioner according to the second embodiment.

FIG. 4 is a schematic view illustrating a refrigerant cycle of an air conditioner according to a second embodiment. FIG. 5 is a flowchart illustrating a method of controlling the air conditioner according to the second embodiment.

In FIG. 4, a basic structure is the same as that of the first embodiment except for an oil level in each compressor. Thus, a characterized part according to the second embodiment will be principally described, and a description of the same part as that of the first embodiment will be omitted.

Referring to FIG. 4, for example, a smaller amount of oil than a required amount of oil is stored in the first and second compressors 11 and 12, and an excessive amount of oil is stored in the third compressor 13.

Referring to FIGS. 4 and 5, when an operation command for the air conditioner is input, the air conditioner operates in a selected mode in operation S11. At this point, at least one of the compressors 11, 12, and 13 operates.

The control part 100 determines whether an open condition of the expansion valve 70 is satisfied in operation S12. As described above, the open condition is a case where at least two of the compressors 11, 12, and 13 operate.

If the control part 100 determines that the open condition of the expansion valve 70 is satisfied, the expansion valve 70 is opened in operation S13.

Then, the refrigerant and/or the oil are discharged from an operating one of the compressors 11, 12, and 13 to a corresponding one of the bypass pipes 51, 52, and 53.

In operation S14, the control part 100 determines whether a temperature sensed at the temperature sensor corresponding to the operating compressor satisfy a reference refrigerant temperature range.

For example, in the state where the first and second compressors 11 and 12 operate and the third compressor 13 stops, when the expansion valve 70 is opened, the refrigerant is discharged from the first and second compressors 11 and 12. In this state, it is difficult to balance the oil levels of the compressors 11, 12, and 13. In addition, in this state, temperatures sensed at the first and second temperature sensors 60 and 61 corresponding to the first and second compressors 11 and 12 satisfy the reference refrigerant temperature range.

Thus, as a result of the determining in operation S14, if temperatures sensed at temperature sensors corresponding to operating compressors satisfy the reference refrigerant temperature range, the expansion valve 70 is closed in operation S15, and operation S11 is performed again.

On the contrary, as a result of the determining in operation S14, if temperatures sensed at temperature sensors corresponding to operating compressors do not satisfy the reference refrigerant temperature range, the control part 100 determines, in operation S16, whether the temperatures sensed at the temperature sensors corresponding to the operating compressors satisfy a reference oil balance temperature range.

If the temperatures sensed at the temperature sensors corresponding to the operating compressors do not satisfy the reference refrigerant temperature range, all the compressors 11, 12, and 13 operate, or the first compressor 11 and one of the second and third compressors 12 and 13 operate.

In this case, if two compressors of the compressors 11, 12, and 13 operate, a check valve prevents a fluid to be introduced to the stopped compressor.

As a result of the determining in operation S16, if the temperatures sensed at the temperature sensors corresponding to the operating compressors satisfy the reference oil balance temperature range, the oil levels of the operating compressors are balanced, and thus, the expansion valve 70 is closed in operation S17, and operation S11 is performed again.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a plurality of compressors;

discharge pipes to discharge a fluid compressed in the plurality of compressor;

oil separators connected to the discharge pipes to separate oil from the fluid;

oil recycle pipes to introduce the oil to the plurality of compressors;

an intake passageway configured to distribute the fluid to each of the compressors;

a bypass unit to guide the fluid from the plurality of compressors to the intake passageway, the bypass unit including:

a plurality of bypass pipes connected respectively to the compressors to discharge the fluid from the compressors;

a common bypass pipe to connect the plurality of bypass pipes with the intake passageway, the common bypass pipe being disposed between the plurality of bypass pipes and the intake passageway;

depressurization parts installed at the plurality of bypass pipes to depressurize the fluid; and a plurality of temperature sensors configured to sense temperatures of the fluids discharged from the depressurizing parts, an expansion valve disposed between the common bypass pipe and the intake passageway to control a flow rate of fluid from the common bypass pipe to the intake passageway;

a memory to store information of a reference refrigerant temperature range R1 of the refrigerant discharged from the depressurizing parts and a reference oil balance temperature range R2 of a mixed fluid of the refrigerant and oil discharged from the depressurizing parts, the R2 being higher than the R1; and a control part configured to control the operation of the expansion valve, based upon result of comparison of the temperature sensed at the temperature sensors with at least one of the R1 or R2.

2. The air conditioner according to claim 1, wherein the intake passageway comprises:

a common intake pipe through which the fluid to be introduced to each of the compressors flows; and a plurality of individual intake pipes branched from the common intake pipe and connected respectively to the compressors.

3. The air conditioner according to claim 1, wherein the expansion valve comprises an electronic expansion valve.

4. The air conditioner according to claim 1, wherein the bypass pipes are provided respectively with the depressurization parts to depressurize a fluid.

5. The air conditioner according to claim 1, wherein each of the bypass pipes is provided with a one-way check valve, wherein each check valve allows a fluid to flow from each of the bypass pipes to the common bypass pipe.

6. The air conditioner according to claim 1, further comprising a control part configured to control the operation of the expansion valve, wherein the control part opens the expansion valve when an open condition of the expansion valve is satisfied.

7. The air conditioner according to claim 6, wherein when the valve is opened, the control part determines whether a temperature sensed at the plurality of temperature sensors corresponding to an operating one of the plurality of compressors satisfies the reference oil balance temperature range R2.

8. The air conditioner according to claim 7, wherein, when the temperature sensed at the temperature sensor corresponding to the operating compressor satisfies the reference oil balance temperature range R2, the valve is closed.

9. The air conditioner according to claim 7, wherein when the open condition of the valve is satisfied, all the compressors operate.

10. The air conditioner according to claim 9, wherein when temperatures sensed respectively at the temperature sensors satisfy the reference oil balance temperature range R2, the valve is closed and the compressors are returned to states provided before the valve is opened.

* * * * *